US005379999A

United States Patent [19]

Barzideh et al.

[11] Patent Number: 5,379,999

[45] Date of Patent: Jan. 10, 1995

[54] SHEET MEDIA HANDLING APPARATUS

[75] Inventors: Bijan Barzideh, W. Henrietta; Timothy Lewis, Hilton; Dean Smith, Pittsford, all of N.Y.

[73] Assignee: Eastman Kodak Company, Rochester, N.Y.

[21] Appl. No.: 97,348

[22] Filed: Jul. 23, 1993

[51] Int. Cl.[6] ..... B65H 5/00

[52] U.S. Cl. ..... 271/264; 417/14; 417/423.1; 271/195; 310/63

[58] Field of Search ..... 271/276, 264, 194–197, 271/96, 97, 98, 105, 183; 318/254; 310/63, 62; 417/14, 420, 423.1

[56] References Cited

U.S. PATENT DOCUMENTS

| | | | |
|---|---|---|---|
| 3,829,250 | 4/1974 | Samson | 417/423.1 |
| 4,164,690 | 8/1979 | Muller et al. | 318/254 |
| 4,421,306 | 12/1983 | Muka | 271/5 |
| 4,504,751 | 3/1985 | Meier | 310/63 |
| 4,553,075 | 11/1985 | Brown et al. | 310/63 |
| 4,554,491 | 11/1985 | Plunkett | 310/63 |
| 4,572,071 | 2/1986 | Cappel et al. | 271/195 |
| 4,643,414 | 2/1987 | Weisgerber | 271/183 |
| 4,647,033 | 3/1987 | Emrich | 271/276 |
| 5,099,181 | 3/1992 | Canon | 310/62 |
| 5,150,131 | 9/1992 | Jaoudour | 271/276 |
| 5,251,891 | 10/1993 | Blazer et al. | 271/204 |

*Primary Examiner*—H. Grant Skaggs
*Attorney, Agent, or Firm*—Thomas H. Close

[57] ABSTRACT

A sheet media handling apparatus includes an air plenum having a first set of openings for passing air in the vicinity of a sheet media being handled and a second opening; and a fan including a flat brushless DC motor mounted adjacent the second opening and a centrifugal impeller attached to the motor and positioned so as to move air through the second opening when rotated by the motor. A pressure sensor connected to the motor drive circuit controls the speed of the motor in an inverse relationship to atmospheric pressure so that sufficient air pressure is provided for the sheet handling apparatus while minimizing the noise generated by the apparatus.

5 Claims, 4 Drawing Sheets

SHEET MEDIA HANDLING APPARATUS

FIELD OF THE INVENTION

The present invention relates to sheet media handling apparatus and more particularly to sheet media handling apparatus employing air flow to control the sheet media.

BACKGROUND OF THE INVENTION

Many medium and high volume copiers and printers such as electrophotographic printers employ sheet media transport systems that use air flowing through holes in a plenum adjacent to the sheet media to control the sheet media. One example is the document feeder shown in U.S. Pat. No. 4,421,306 issued Dec. 20, 1983 to Muka.

Air movers such as fans and blowers having a rotating impeller (hereinafter referred to simply as fans) used to provide air pressure to such sheet media handling apparatus tend to be large and noisy. Because large fans cannot be fitted easily within the media path, ducts are used to direct air flow to the plenums used for media transport. The use of the ducts causes aerodynamic losses which necessitate the fans be even larger and/or run at a higher speed and hence noisier. A second problem occurs when the apparatus is employed at high altitudes, such as in Denver, Colo. Obtaining adequate performance of the sheet media handling apparatus in a lower density air at high altitudes requires a higher flow rate which in turn requires a higher fan speed. A machine designed to perform adequately at the highest elevation that may be encountered will be unnecessarily noisy at lower elevations where the extra air flow is not required. Consequently, it is the current practice to manually adjust the speed of the fan for installation of equipment at high altitudes. It is the object of the present invention to solve these shortcomings in the prior art sheet media handling apparatus.

SUMMARY OF THE INVENTION

The above noted problems are solved according to the present invention by providing a sheet media handling apparatus including an air plenum having a first set of openings for passing air in the vicinity of the sheet media being handled and a second opening; and a fan including a flat brushless DC motor adjacent the second opening and a centrifugal impeller attached to the motor and positioned so as to move air through the second opening when rotated by the motor. According to a further aspect of the invention, the sheet media handling apparatus includes an instrument for sensing atmospheric pressure and generating a signal. A motor drive circuit receives the signal and automatically adjusts the speed of the motor for optimum low noise operation for the given atmospheric pressure conditions. The present invention is advantageous in that the sheet media handling apparatus produces lower noise than the prior art systems because the fan and motor can be located directly in or adjacent to the media handling plenum. The invention has the further advantage that changes in atmospheric pressure due to altitude changes are automatically compensated for, thereby achieving the minimum noise possible for each operating location. The invention has the further advantage that the overall size of a copier or printer may be reduced since the multiple air ducts leading to the plenums in the prior art approach can be eliminated.

DETAILED DESCRIPTION OF THE INVENTION

Figure 1:
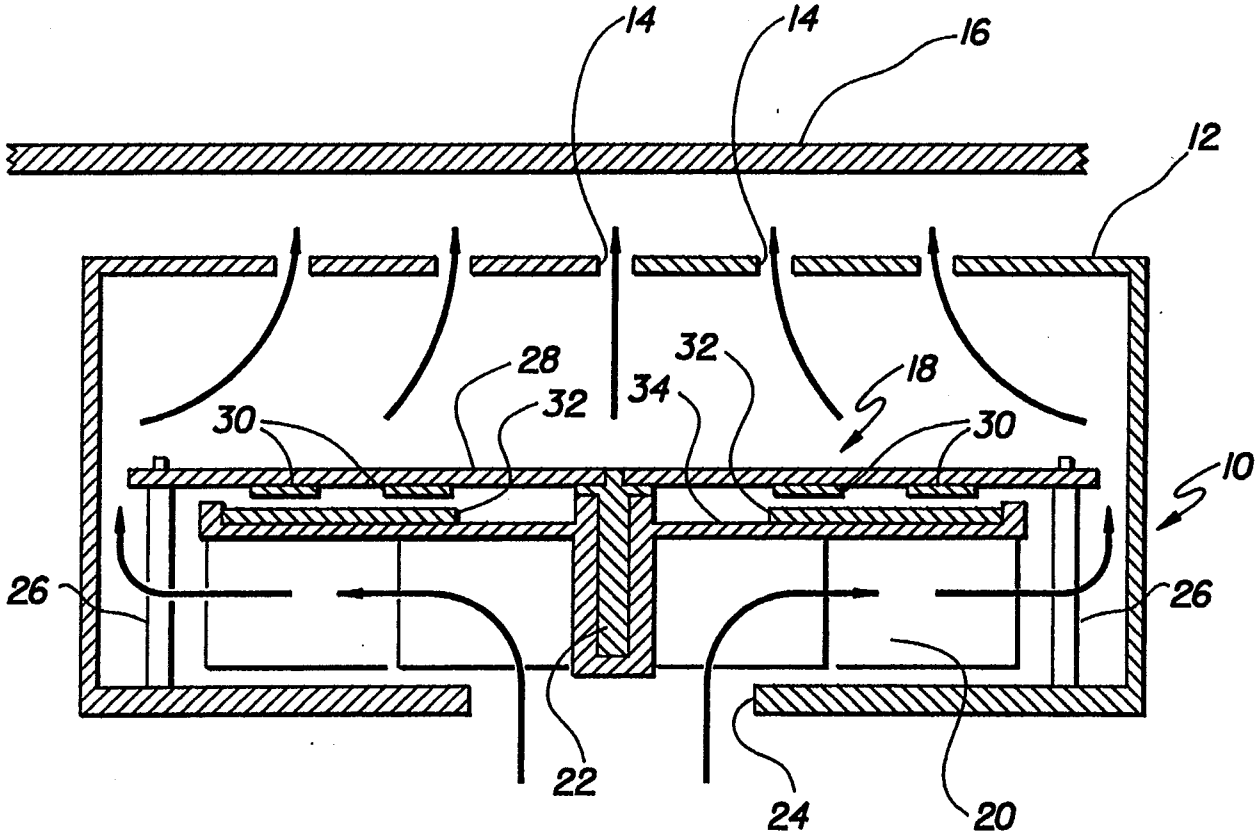
FIG. 1 is a schematic cross sectional view of an air transport sheet media handling apparatus according to the present invention.

Referring now to FIG. 1, a sheet media handling apparatus according to the present invention, generally designated 10, includes a plenum 12 defining a first set of openings 14 for passing air in the vicinity of the sheet 16. In this embodiment, the sheet media handling apparatus supports the sheet 16 on a cushion of air expelled from the openings 14. The fan (shown in cross section) includes a flat brushless DC motor 18 and an impeller 20 mounted for rotation on the motor shaft 22. The motor 18 is mounted in the plenum 12 adjacent a second opening 24 on posts 26. The flat brushless DC motor 18 includes a base plate 28 which carries a plurality of stationary flat windings 30. The circular magnet 32 is magnetized in sectors in an axial direction, each sector alternating the direction of magnetization. The circular magnet 32 is carried by a rotor 34 on which the impeller 20 is also carried.

Figure 2:
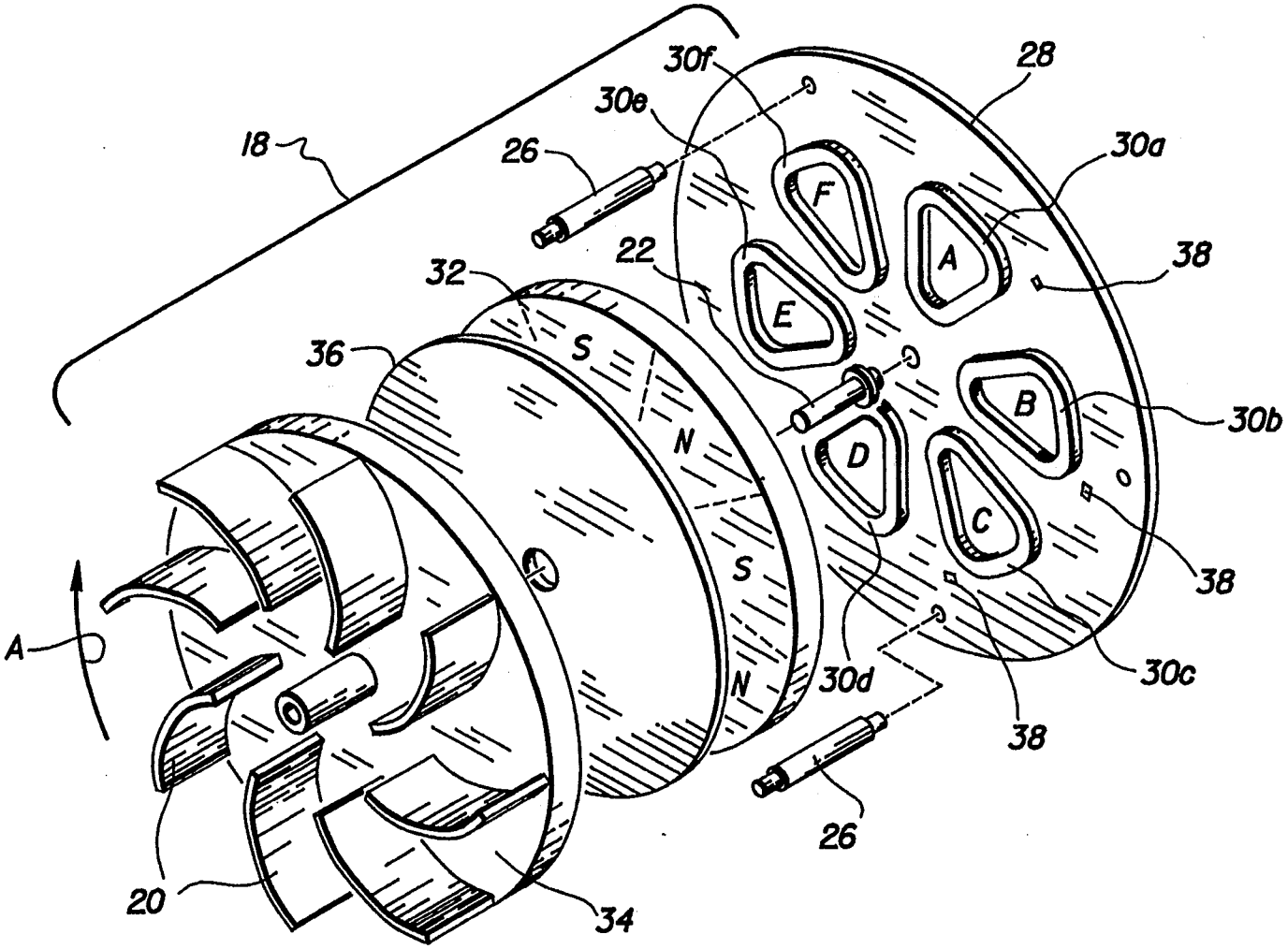
FIG. 2 is an exploded perspective view of the fan employed in the sheet media handling apparatus of FIG. 1.

FIG. 2 shows the fan 18 in exploded perspective. The rotor 34 and impeller 20 may be formed in one piece for example by injection molding. A flux return plate 36 of magnetically permeable material (not shown in FIG. 1) is located in the rotor 34 behind circular magnet 32. The circular magnet 32 is magnetized in an axial direction (i.e. parallel to motor shaft 22) and preferably includes 8 sections alternately magnetized north to south and south to north. Three Hall sensors 38 are connected to a motor control circuit in a known manner to control the brushless DC motor 18. The flat windings 30 of which there are preferably six, designated 30*a–f* in FIG. 2, are preferably connected in a three phase pattern as is well known in the art. Although the specific dimensions of the fan will vary depending upon the requirements of the specific application, the preferred impeller for an air transport system in an electrophotographic copier would be 6–15 cm in diameter and 1–2 cm deep, with 6–12 backward curved blades. By "backward curved" it is meant that the impeller blades 20 are curved as shown in FIG. 2 while the rotor rotates in the direction of arrow A. The preferred flat brushless DC motor for such an application would be 6 cm in diameter and 7.5 mm thick with three phase windings, operated at 24 volts to run open loop at between 3,000–6,000 rpm.

Figure 3:
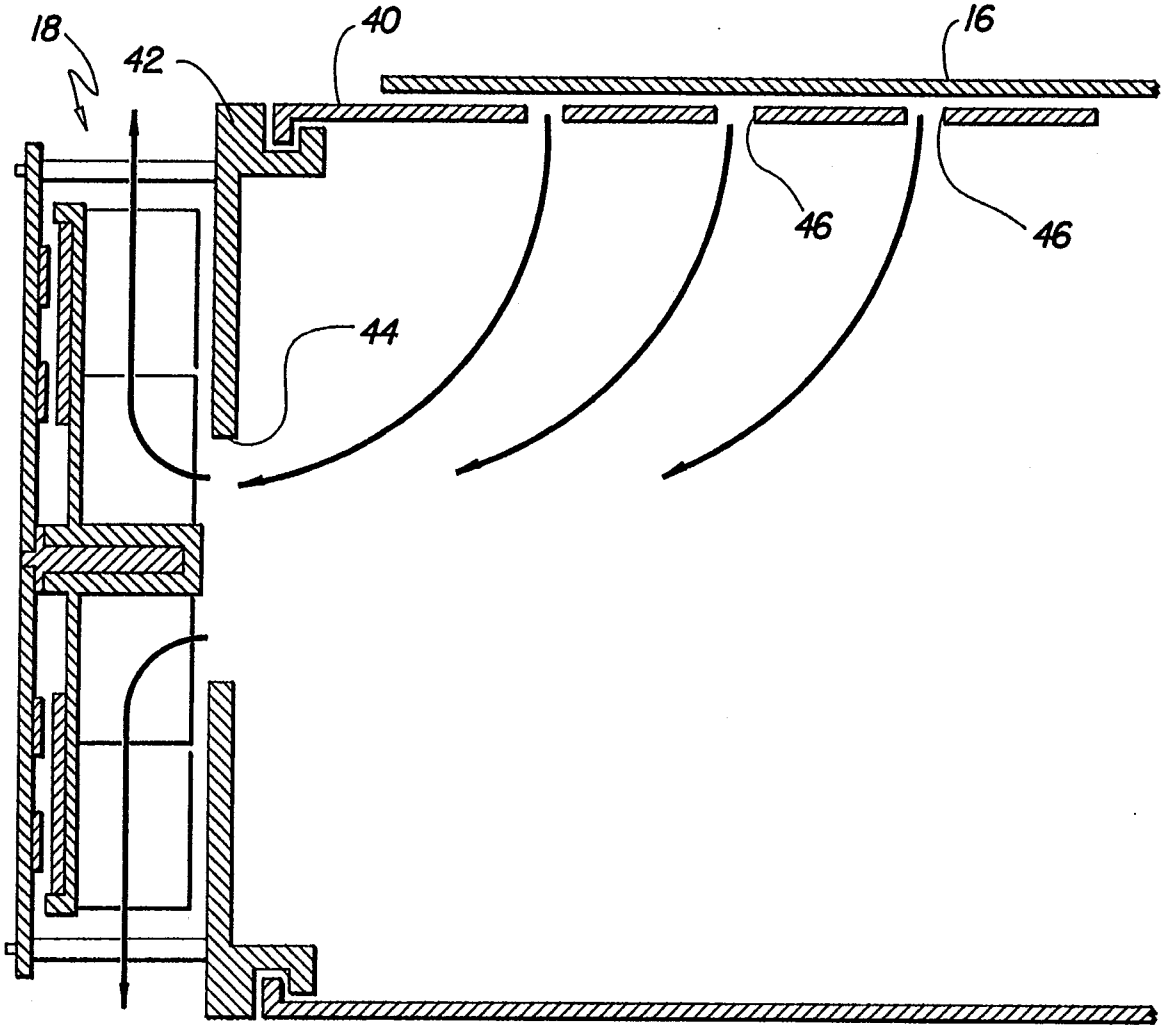
FIG. 3 is a schematic diagram showing an alternative embodiment of the sheet media handling apparatus according to the invention.

FIG. 3 shows another embodiment of the invention where parts identical to those in FIG. 1 are given the same reference numerals as those in FIG. 1. In the embodiment shown in FIG. 3, the fan 18 is mounted at the end of a vacuum cylinder 40 for handling sheet media 16. The vacuum cylinder 40 cooperates with an end cap 42 to form an air seal that leaves the vacuum cylinder 40 free to rotate. Air is pulled from the vacuum cylinder 40 through an opening 44 in the end cap to form a partial vacuum in the cylinder 40. Air is drawn in the vacuum cylinder 40 through ports 46 to attach the sheet media to the cylinder for transport.

Figure 4:
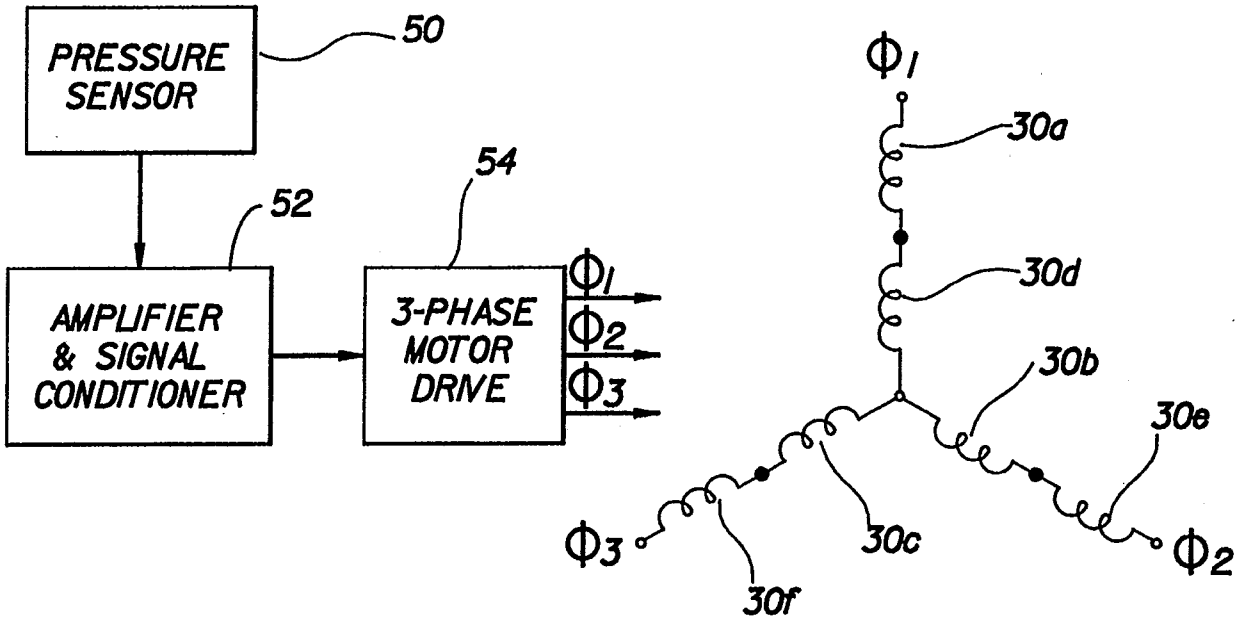
FIG. 4 is a schematic diagram of the motor control circuit employed with the preferred embodiment of the sheet media handling apparatus according to the present invention.

According to a further aspect of the present invention, a pressure sensor is employed to sense the ambient atmospheric pressure and to adjust the speed of the can 18 such that only sufficient pressure for operation of the media transport is provided, but not more, since higher pressures result in higher noise levels. Turning to FIG. 4 a control circuit employing an atmospheric pressure sensor for controlling the fan motor is shown. The control circuit includes a pressure sensor 50 that is mounted outside the air plenum. Preferably the pressure sensor 50 utilizes a monolithic silicon piezoresistor which generates a small voltage proportional to ambient atmospheric pressure. The output of the pressure sensor is inverted and amplified to a useful voltage of between 1–10 volts DC by amplifier and signal conditioner 52. The signal from the amplifier and signal conditioner 52 is applied to a three phase motor drive circuit 54 which provides the three phase drive voltages $\phi 1$, $\phi 2$, $\phi 3$ to the coils 30*a–f* of the motor. As shown in FIG. 4, the coils 30*a–f* are connected in the well known WYE configuration. Thus at higher altitudes (lower atmospheric pressure) the inverted output from the pressure sensor will be higher to make the motor run faster, and at lower altitudes, the output will be lower to make the motor run slower. The motor control circuit of FIG. 4 provides a linear relationship between atmospheric pressure and motor speed, and is adjusted so that only sufficient air pressure is provided by the fan at any atmospheric pressure thereby keeping noise to a minimum while providing adequate air pressure to operate the sheet media handling apparatus.

PARTS LIST

10 sheet media handling apparatus
12 plenum
openings
16 sheet
18 motor
20 impeller
22 motor shaft
24 second opening
26 posts
28 base plate
30*a–f* windings
32 circular magnet
34 rotor
36 return plate
38 sensors
40 vacuum cylinder
42 end cap
44 opening
46 ports
50 pressure sensor
52 signal conditioner
54 motor drive circuit

We claim:

1. A sheet media handling apparatus, comprising:

a. an air plenum having a first set of openings for passing air in the vicinity of a sheet of media being handled, and a second opening;

b. a fan including a flat brushless DC motor mounted adjacent said second opening, and a centrifugal impeller having backward curved blades attached to said motor and positioned so as to move air through said second opening when rotated by said motor;

c. an instrument for sensing atmospheric pressure and generating a signal representative thereof; and d. motor drive circuit connected to said motor and responsive to said pressure signal for controlling the speed of said motor as an inverse function of atmospheric pressure.

2. The sheet media handling apparatus claimed in claim 1, wherein said impeller is 6–15 cm in diameter and 1–2 cm deep, with 6–12 blades; said motor is 6 cm in diameter, 7.5 mm thick with 3 phase coil windings and is operated at 24 volts to run at between 3,000–6,000 rpm.

3. A sheet media handling apparatus, comprising:

a. an air plenum having a first set of openings for passing air in the vicinity of a sheet of media being handled, and a second opening;

b. a fan including a motor mounted adjacent said second opening, and an impeller having blades attached to said motor and positioned so as to move air through said second opening when rotated by said motor;

c. an instrument for sensing atmospheric pressure and generating a signal representative thereof; and d. a motor drive circuit connected to said motor and responsive to said pressure signal for controlling the speed of said motor as an inverse function of atmospheric pressure.

4. The sheet media handling apparatus claimed in claim 3, wherein said motor is a flat brushless DC motor.

5. The sheet media handling apparatus claimed in claim, wherein said impeller is a centrifugal impeller.

* * * * *